US008454097B2

(12) United States Patent
Gueret

(10) Patent No.: US 8,454,097 B2
(45) Date of Patent: Jun. 4, 2013

(54) APPLICATOR, A PACKAGING AND APPLICATOR DEVICE INCLUDING SUCH AN APPLICATOR, A METHOD OF MANUFACTURING SUCH AN APPLICATOR, AND A MACHINE FOR MANUFACTURING SUCH AN APPLICATOR

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 12/585,333

(22) Filed: Sep. 11, 2009

(65) Prior Publication Data

US 2010/0007193 A1 Jan. 14, 2010

Related U.S. Application Data

(62) Division of application No. 11/474,313, filed on Jun. 26, 2006, now abandoned.

(60) Provisional application No. 60/701,063, filed on Jul. 21, 2005.

(30) Foreign Application Priority Data

Jun. 29, 2005 (FR) ..... 05 51825

(51) Int. Cl.
*A45D 34/04* (2006.01)

(52) U.S. Cl.
USPC ..... 300/21; 15/144.1; 15/167.3; 15/172; 16/225; 132/218; 132/320; 264/293; 264/320; 401/129

(58) Field of Classification Search
USPC .. 15/143.1, 144.1, 144.2, 167.3, 172; 16/225; 132/200, 218, 320; 264/293, 320, 322; 300/21; 401/126–130
See application file for complete search history.

(56) References Cited

U.S. PATENT DOCUMENTS

| | | | | |
|---|---|---|---|---|
| 2,559,825 | A | 7/1951 | McKinney, Jr. | |
| 3,222,437 | A * | 12/1965 | Schilling | 264/54 |
| 3,320,225 | A * | 5/1967 | Bradbury | 428/156 |
| 3,350,492 | A * | 10/1967 | Grootenboer | 264/320 |
| 3,447,199 | A * | 6/1969 | Trimble | 16/225 |
| 3,900,550 | A * | 8/1975 | Oliver et al. | 264/320 |
| 4,594,816 | A * | 6/1986 | Goldstein | 451/524 |
| 4,712,266 | A * | 12/1987 | Yamaki | 15/167.1 |
| 4,725,463 | A * | 2/1988 | Baumber et al. | 428/33 |
| 5,001,803 | A | 3/1991 | Discko, Jr. | |
| 5,150,495 | A | 9/1992 | Discko, Jr. et al. | |
| 5,888,005 | A | 3/1999 | Gueret | |
| 6,033,143 | A | 3/2000 | Gueret | |
| 6,049,934 | A * | 4/2000 | Discko | 15/106 |
| 6,227,737 | B1 * | 5/2001 | Lightfoot | 401/129 |
| 6,341,912 | B1 | 1/2002 | Gueret | |
| 6,634,051 | B1 * | 10/2003 | Dragan et al. | 15/106 |

(Continued)

FOREIGN PATENT DOCUMENTS

| | | | |
|---|---|---|---|
| DE | 27 37 667 | A1 | 2/1979 |
| DE | 19744181 | * | 4/1999 |

(Continued)

*Primary Examiner* — Mark Spisich
(74) *Attorney, Agent, or Firm* — Oliff & Berridge, PLC

(57) ABSTRACT

An applicator for applying a cosmetic or a skin care product may include a stem including at least one stamped portion forming a joint, and an applicator member disposed at a first end of the stem.

29 Claims, 5 Drawing Sheets

U.S. PATENT DOCUMENTS

| | | | |
|---|---|---|---|
| 2005/0031401 | A1 | 2/2005 | Gueret |
| 2005/0238409 | A2 | 10/2005 | Gueret |
| 2006/0124147 | A1 | 6/2006 | Lo |

FOREIGN PATENT DOCUMENTS

| | | | | |
|---|---|---|---|---|
| EP | 1 477 083 | A1 | | 11/2004 |
| EP | 1 504 691 | A1 | | 2/2005 |
| FR | 2 722 380 | A1 | | 1/1996 |
| FR | 2 722 381 | A1 | | 1/1996 |
| JP | 2001-197932 | | * | 7/2001 |

* cited by examiner

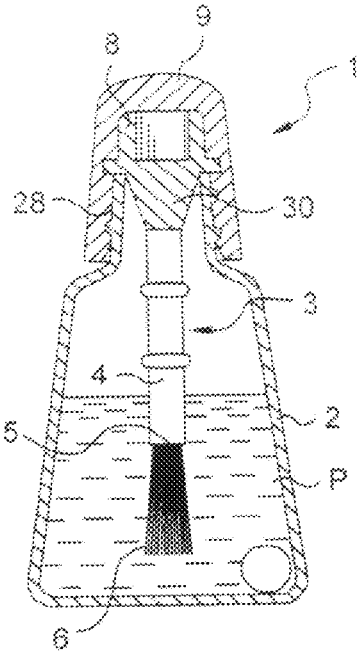
Fig.1
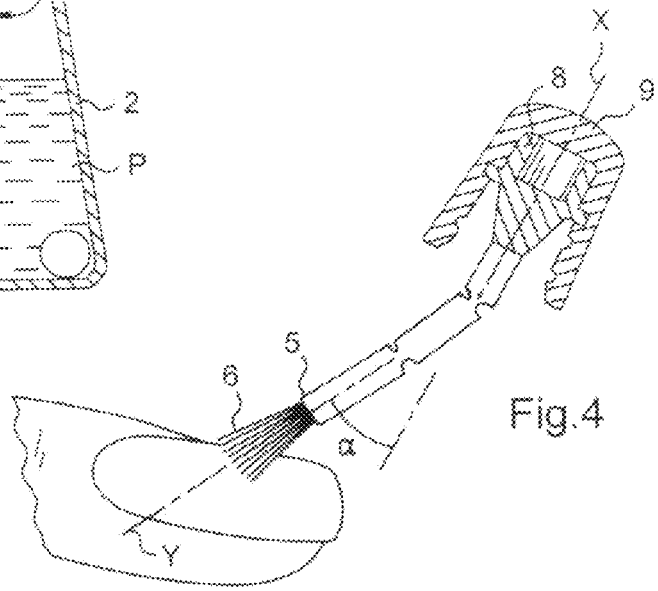
Fig.4
Fig.2
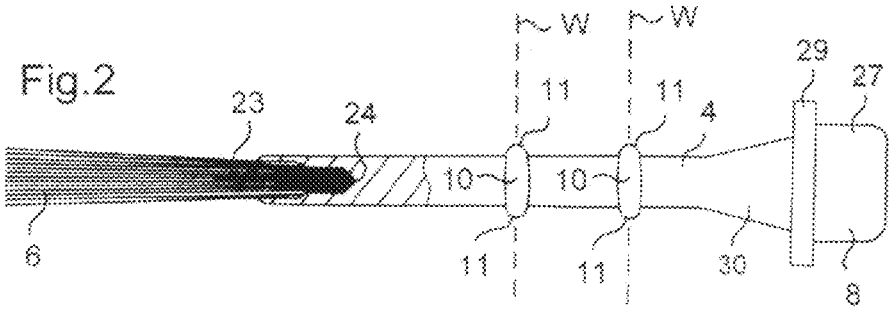
Fig.3
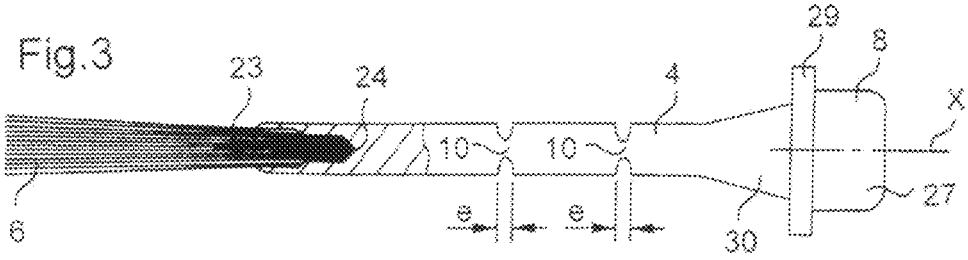

Fig.5
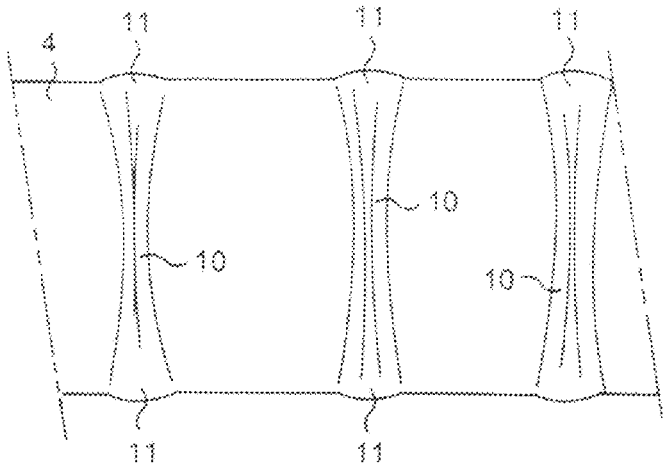
Fig.6
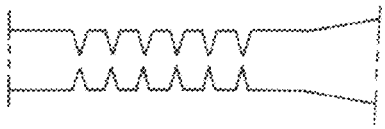
Fig.7
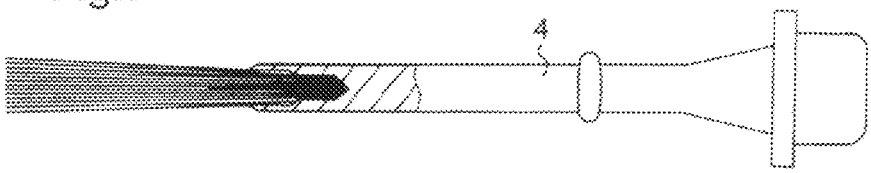
Fig.8
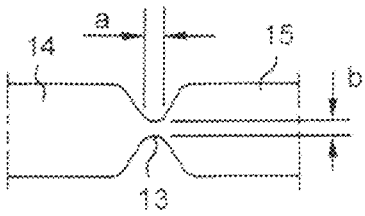
Fig.9
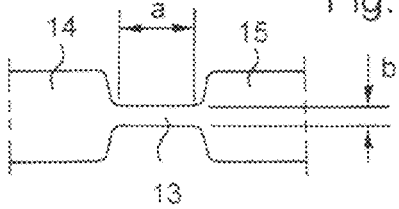
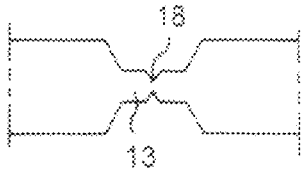
Fig.10
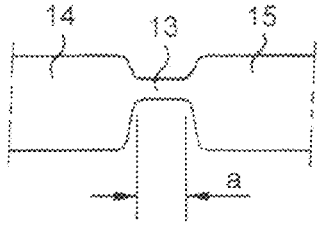
Fig.11

Fig.23
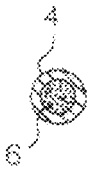
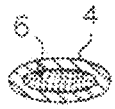
Fig.24
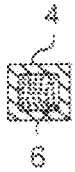
Fig.25
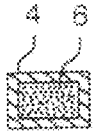
Fig.26
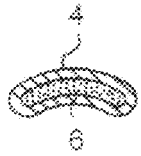
Fig.27
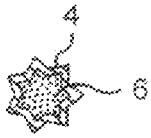
Fig.28
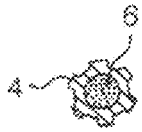
Fig.29
Fig.30
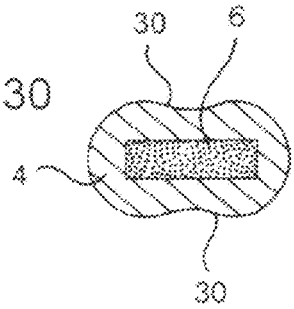
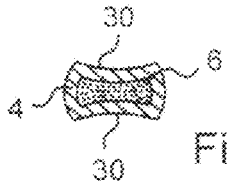
Fig.31
Fig.32
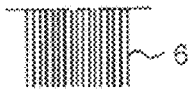
Fig.33
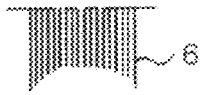
Fig.34
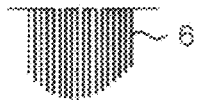
Fig.35
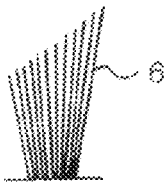
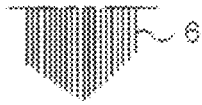
Fig.36

Fig.37
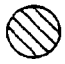
Fig.38
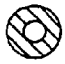
Fig.39
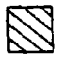
Fig.40
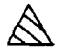
Fig.41
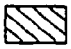
Fig.42
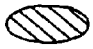
Fig.43
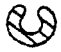
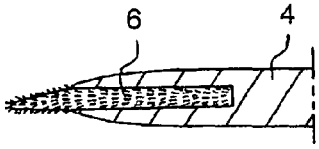
Fig.44
Fig.45
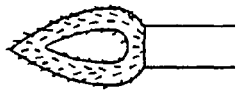
Fig.46
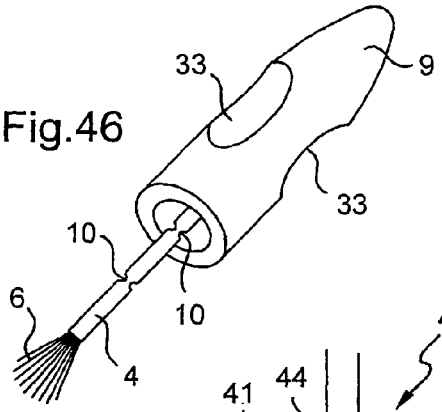
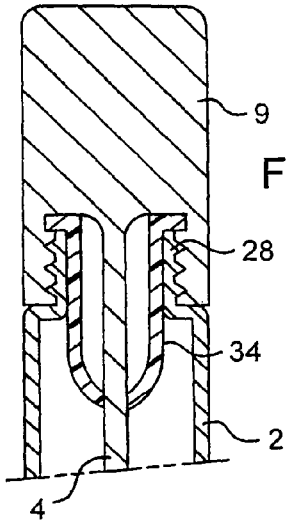
Fig.47
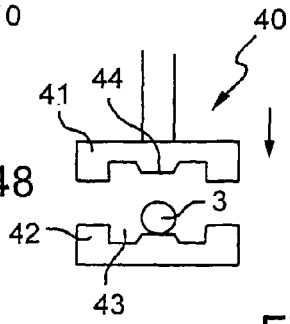
Fig.48
Fig.49
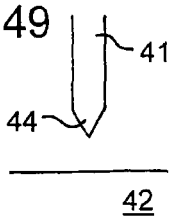
Fig.50
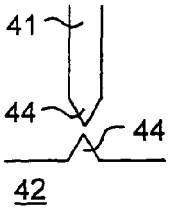
Fig.51
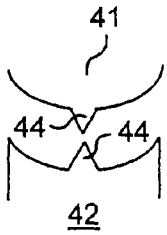

APPLICATOR, A PACKAGING AND APPLICATOR DEVICE INCLUDING SUCH AN APPLICATOR, A METHOD OF MANUFACTURING SUCH AN APPLICATOR, AND A MACHINE FOR MANUFACTURING SUCH AN APPLICATOR

CROSS-REFERENCE TO RELATED APPLICATIONS

This is a Divisional of application Ser. No. 11/474,313 filed on Jun. 26, 2006, now abandoned which is a non-provisional application that claims the benefit of French Application No. 05 51825 filed on Jun. 29, 2005 and U.S. Provisional Application No. 60/701,063 filed on Jul. 21, 2005. The disclosures of the prior applications are hereby incorporated by reference herein in their entireties.

The present invention relates to applicators for applying a cosmetic or a care product, for example, makeup or a skin care product, for example, a composition such as a nail varnish. The present invention also relates to packaging and applicator devices including such applicators.

BACKGROUND

Numerous applicators comprise an applicator member, for example, a bundle of bristles, fastened to an end of a stem for applying composition to a surface of the human body, for example, skin, lips, hair, or nails, for example, fingernails or toenails.

French patent applications FR-A-2 722 380 and FR-A-2 722 381 disclose applicators having a stem that includes flexibility that is close to a flexibility of the applicator member, the stem being, over a large portion of a length thereof, of smaller cross-section than a remainder of the stem.

Patent application EP-A-1 504 691 discloses an applicator including a stem having a flexible portion with shape memory, and a bottom half that is substantially non-flexible.

SUMMARY

Stems such as those disclosed in FR-A-2 722 380 and FR-A-2 722 381 may be molded. It may be necessary for each type of applicator to modify the length of the portion of smallest cross-section, thereby requiring several molds to be made, correspondingly resulting in relatively high costs.

Fastening the applicator member in a flexible stem, such as disclosed in EP-A-1 504 691, for example, by implanting a bundle of bristles, a flocked endpiece, felt, or a foam in the stem, may be made more difficult by the fact that the stem may bend easily. To avoid that problem, it is possible to hold the stem during the fastening operation, but that complicates assembly.

There exists a need to have an applicator that makes it possible to apply makeup accurately, while being comfortable to use.

There also exists a need to make it easier to manufacture an applicator including a stem that has a desired deformability characteristics, while avoiding the use of costly molds.

There also exists a need to make it possible to implant the applicator member easily into the stem.

Exemplary embodiments of the invention seek, for example, to satisfy such needs, in full or in part.

Exemplary embodiments of the invention may achieve one or more of such advantages by providing an applicator for applying a cosmetic or a skin care product, the applicator comprising: a stem including at least one stamped portion comprising a joint; and an applicator member disposed at a first end of the stem.

The term "stamped portion" should be understood as a portion of the stem that is deformed hot or cold by being subjected to pressure of a die. The stem of the applicator may advantageously be deformed once the stem has been molded and removed from the mold.

It may thus be possible to use standard stems without it being necessary to make specific molds.

The material of the stem may creep under the pressure of the die. Where appropriate or desired, the die may be configured in such a manner as to orientate deformation generated by the creep so as to form a portion in relief, which may make it possible to regulate flow of composition along the stem.

The stamped portion may substantially maintain the deformation acquired during stamping, without returning to an initial shape thereof during the lifetime of the applicator.

During stamping, depending on the flexibility desired, and on the kind of stem, a thickness of the stem may be reduced by at least 50%, for example, or even by at least 97%, for example, in a direction in which the pressure is applied to cause the material to creep.

The thickness of the stem prior to creep may be 3.5 millimeters (mm), and a minimum thickness of the stamped portion may not be greater than 0.1 mm, for example, such exemplary values in no way limiting the invention.

The joint may make it possible to create a hinge and/or a zone of weakness that enables two adjacent stem segments to change orientation relative to each other. The joint-forming stamped portion may not serve to fasten the applicator member on the stem.

Exemplary embodiments may make it possible to create a wide variety of stems including at least one joint, without the need to manufacture specific molds. Thus, at least during use, the stem may be given a non-rectilinear shape.

Exemplary embodiments may make it possible to reduce pressure of the applicator member on the treated surface by the stem deforming. The applicator may enable a user to have a better application technique that is more flexible, more comfortable, and/or more accurate.

The stem may include at least one bead resulting from stamping. The stamped bead may form a lateral projection on the stem.

The stem may include at least two stamped portions, indeed three or even more, each portion comprising a respective joint. The stamped portions may be made simultaneously with a common die, or successively by displacing the stem relative to the die, for example.

The stamped portion need not be circularly symmetrical, so as to encourage the creation of a joint about a predefined hinge axis. For example, the stamped portion may comprise a bridge of material including a flat shape in cross-section.

The applicator may be symmetrical about a mid-plane, for example, a plane that is perpendicular to a hinge axis defined by a stamped portion. At least one stamped portion may be situated in a bottom half of the stem.

The stem may include at least one stamped portion including at least one opening, for example, at least one opening disposed between two branches interconnecting stem segments that are situated on either side of the stamped portion. For example, such an opening may be formed during the stamping operation, by being cut out.

A bottom wall of the stamped portion may extend substantially perpendicularly to the longitudinal axis of the stem. In another exemplary embodiment, the bottom wall of at least one stamped portion may extend non-perpendicularly to the longitudinal axis of the stem. The orientation of the stamped portion(s) may be selected as a function of a way in which it is desired that the stem will deform. For example, the stem may include at least two stamped portions that extend along lines that are not parallel.

The stem may include at least two stamped portions of different shapes, for example, because the portions may result from applying two dies of different shapes, or from applying a common die with different pressures and/or on regions of the stem including different initial shapes and/or orientations, for example.

The stem may include at least two stamped portions of a same shape, for example, resulting from the use of a common die.

The stem may include at least two stamped portions including a same profile when the stem is observed in a direction that is perpendicular to the longitudinal axis thereof. The two stamped portions may optionally be symmetrical to each other about a plane, for example, a plane extending perpendicularly to the longitudinal axis of the stem.

At least one stamped portion may include at least one projection of material that may be situated on at least one flank of a stem segment that may be connected to the stamped portion. The projection may be formed during the stamping operation, for example, by giving a corresponding shape to the die. The projection may correspond to a portion of the material that is displaced by creep. The stem may include at least two flanks that are situated on either side of the stamped portion, sloping relative to the longitudinal axis of the stem, and indeed substantially perpendicular to the stem. Where appropriate or desired, the shape of the stamped portion may be selected in such a manner as to define a maximum pivot angle of adjacent stem segments, by one flank coming into abutment against the other. The stamped portion may thus be configured to limit a degree to which the stem segments that are situated on either side of the stamped portion may pivot relative to each other.

The stamped portion may extend over various lengths, depending on a degree to which the hinge is to be localized, for example. The length of the stamped portion may be up to 25 mm, for example, although a shorter length is preferred in most applications.

At least one stamped portion may include a longitudinal cross-section of shape that may be generally rectangular, triangular, or even circular, oval, or elliptical, at least in part, depending on a shape of the die used, for example.

The shape of the cross-section of the stem may be selected from: circular, non-circular, oblong, oval, elliptical, polygonal, square, rectangular, kidney-shaped, notched, or star-shaped, and with one or more grooves, where appropriate or desired. Prior to stamping, the stem may optionally include a cross-section that is constant, and may be solid or hollow over an entire length thereof or in portions, for example. For example, the stem may be solid in a joint-forming stamped portion, and may be hollow elsewhere. For example, a diameter of the stem may be less than about 10 mm.

The stem may be made of a thermoplastic material, for example, at least one of the materials selected from the group constituted by: high-density polyethylene (HDPE), low-density polyethylene (LDPE), linear polyethylene (linear PE), polypropylene (PP), polyoxymethylene (POM), polyamide (PA), polyethylene (PET), and polybutyl terephthalate (PBT), or a mixture of such materials. Linear PE may provide better resistance to pressure and forces exerted during stamping.

The applicator member may comprise at least one of: a bundle of bristles, for example, comprising a paint brush; a comb; a brush; felt; a flocked coating; and a foam. For example, the applicator member may comprise a flocked endpiece, for example, a flocked tip.

In exemplary embodiments in which the applicator member comprises a bundle of bristles, at least two bristles of the bundle may each include a respective periodic pattern including at least one wave, with at least two periodic patterns being different. The expression "periodic pattern" refers to a portion of the bristle that is reproduced substantially periodically along the bristle.

The bundle of bristles may comprise at least two bristles of lengths, and/or diameters, and/or cross-sections, and/or materials that are different.

The bristles may be made of synthetic material, for example, a thermoplastic material, for example, thermoplastic elastomer. At least one bristle may be made of a natural material.

The bristles may include cross-sections that are solid or hollow and optionally circular. The cross-sections need not be constant along the bristles, for example, alternating between cross-sections of relatively large diameter and cross-sections of relatively small diameter. The bristles may possibly be coated in flocking.

Over an entire length thereof, or over a fraction only of the length thereof, the bristles may also include a filler, for example, of a magnetic compound, or a moisture-absorbing compound, or a compound for creating roughness on a surface of the bristle, or even for favoring sliding. The filler may be distributed in such a manner as to create a periodic pattern.

The bundle of bristles may be fastened in a housing formed at the first end of the stem. The bristles may be configured, for example, to be fastened in the housing by adhesive, stapling, stamping the stem, heat sealing, and/or injection molding. The housing may include an oblong cross-section that is elongate along a long axis, so as to form a flat bundle. For example, the long axis of the cross-section of the housing may be substantially parallel to a hinge axis defined by a stamped portion.

The housing may include a cross-section that decreases toward an end wall thereof, with a degree to which the cross-section decreases depending on a degree to which the bristles are to diverge. The end wall of the housing may include a recess in which the bristles are fastened, and which opens into a portion of the housing that flares toward the opening of the housing. Such a flared portion may enable the bristles to spread out more easily from each other so as to give the bundle a wide shape.

The housing may be configured in such a manner that the bristles extend from the housing over a distance that may be greater than a depth of the housing.

In another exemplary embodiment, the stem and the applicator member may be made as a single part, for example, by injection-molding or by dual-injection-molding.

The stem may also be injection molded on the applicator member.

The applicator may include a handle fastened to a second end of the stem, remote from the first end. The handle of the applicator may also comprise a closure cap configured to close a receptacle containing the composition to be applied.

At a second end thereof, remote from the first end, the stem may include a fastener member configured to be fastened to the handle. The fastener member may include an endpiece configured to be force-fitted and/or snap-fastened in the handle. The endpiece may include a tubular skirt with a collar at a base thereof. The collar may be configured to come to bear against a top surface of a neck of a receptacle containing the composition, ensuring that the receptacle is closed in a leaktight manner, for example. In another exemplary embodiment, the receptacle may be closed in a leaktight manner using other means.

The handle may include fastener means for fastening to a receptacle, for example, a thread.

A shape of the handle need not be circularly symmetrical, thereby favoring a predefined orientation for holding the applicator. The handle may include at least one reception zone configured to receive a finger, for example, a flat or an indent that extends substantially parallel to a hinge axis defined by a stamped portion.

Independently or in combination with the above, exemplary embodiments of the invention may provide a packaging and applicator device for applying a cosmetic composition comprising an applicator as defined above, and a receptacle containing a composition to be applied.

The composition may be a nail composition, for example, a nail varnish or a care product for the nails. In another exemplary embodiment, the composition may be an eyeliner, an eyeshadow, or a lip composition, for example, a lipstick or a lipgloss.

The device may further include a wiper member configured to wipe the applicator member while the applicator member is being removed from the receptacle.

The device may advantageously include means for ensuring that the receptacle is closed in a leaktight manner.

Independently or in combination with the above, exemplary embodiments of the invention may provide a method of manufacturing an applicator as defined above. The method may comprise stamping at least one portion of a stem including an applicator member, so as to form at least one joint.

In exemplary embodiments, the portion of the stem may be stamped at ambient temperature, i.e., cold stamped, without special heating. In another exemplary embodiment, the portion of the stem may be hot stamped.

In exemplary embodiments, a plurality of stamped portions may be formed simultaneously. In another exemplary embodiment, a plurality of stamped portions of the stem may be stamped successively, for example, using a same die, with relative displacement of the stem and the die between the stamping operations.

Independently or in combination with the above, exemplary embodiments of the invention may provide a manufacturing machine that is configured to receive a stem, and that includes a die configured to stamp the stem so as to form a joint on the stem.

The stem may be provided with an applicator member prior to the stamping operation. The die may include a housing that is configured to receive and hold the stem during the stamping operation. Both of the jaws of the die may be movable, or one of them may be stationary.

BRIEF DESCRIPTION OF THE DRAWINGS

Various details of the present invention may will be better understood on reading the following detailed description of non-limiting embodiments, and on examining the accompanying drawings, in which:

FIG. 1 is a diagrammatic longitudinal view in axial cross-section illustrating an exemplary device for applying a composition to nails;

FIGS. 2 and 3 are fragmentary diagrams in axial cross-section illustrating the stem and the applicator member of the device of FIG. 1;

FIG. 4 is a fragmentary diagram in axial cross-section illustrating the applicator of FIG. 1 in use;

FIG. 5 is a larger-scale view illustrating a detail of another exemplary embodiment of the stem;

FIG. 6 is a fragmentary side view of the applicator of FIG. 5;

FIG. 7 is a view similar to FIG. 2 illustrating another exemplary embodiment;

FIGS. 8 to 14 and 16 to 21 are diagrammatic views similar to FIG. 5 illustrating exemplary embodiments of the stem;

FIGS. 23 to 31 are exemplary stem cross-sections taken at the applicator member;

FIGS. 32 to 36 are diagrams illustrating exemplary embodiments of applicator members;

FIGS. 37 to 43 are diagrams illustrating exemplary cross-sections of bristles that are suitable for forming the applicator member;

FIG. 44 is a diagrammatic and fragmentary view in longitudinal cross-section illustrating another exemplary embodiment of the applicator member;

FIG. 45 illustrates another exemplary embodiment of an applicator member;

FIG. 46 is a diagram in perspective illustrating another exemplary embodiment of the applicator;

FIG. 47 is a fragmentary longitudinal cross-section illustrating another exemplary embodiment; and FIGS. 48 to 51 illustrate exemplary dies that make it possible to deform the stem of an applicator.

DETAILED DESCRIPTION OF EMBODIMENTS

Figure 12:
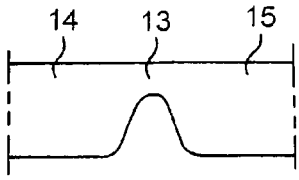

FIG. 1 illustrates a packaging and applicator device 1 comprising a receptacle 2 containing a composition P for application, for example, a nail varnish, and an applicator 3 comprising a stem 4 that carries, at a first end 5, an applicator member 6, and that may be engaged, at a second end 8, in a handle 9 which, in the exemplary embodiment, also constitutes a closure cap of the receptacle 2, and may be configured to be screwed onto the receptacle.

The stem 4 of the applicator 3 is illustrated in isolation in FIGS. 2 and 3.

In exemplary embodiments, the stem 4 may include at least one stamped portion 10 comprising a joint, and specifically two such stamped portions 10 in the exemplary embodiment.

In the exemplary embodiment, each stamped portion may include two beads 11 on two opposite sides of the stem. The stem 4 may thus be widened in a first direction of observation that is perpendicular to a longitudinal axis thereof, as illustrated in FIG. 2.

In a second direction of observation that is perpendicular to the longitudinal axis X and to the first direction, the stem 4 may be made narrower, as illustrated in FIG. 3, and may form a joint that encourages the stem 4 to deform about a hinge axis W.

Thus, each stamped portion 10 may not be circularly symmetrical, and may include a smaller flat cross-section of major axis parallel to the hinge axis W.

Nevertheless, each stamped portion 10 may be substantially symmetrical about a mid-plane that contains the longitudinal axis X of the stem, and that is perpendicular to the corresponding hinge axis W.

As illustrated, at least one stamped portion 10 may be situated in a bottom half of the stem 4, in such a manner as to encourage the stem to deform in a proximity of the applicator member 6, so as to provide flexibility during application.

At least one stamped portion may also be situated in proximity to the end 8 of the stem, for example, in a top half of the stem.

In the exemplary embodiment, the applicator member 6 may comprise a tuft of bristles in such a manner as to form a brush. At the first end 5, the stem 4 may include a housing 23 inside which the bristles are fastened, for example, by stapling, adhesive, heat sealing, and/or injection molding. For example, the housing 23 may include an opening of rectangular cross-section, of elongate shape along a major axis that is perpendicular to the longitudinal axis X of the stem 4, and that is parallel to the hinge axes W.

As illustrated in FIGS. 2 and 3, the housing 23 may include a cross-section that decreases toward the end wall 24 of the housing. The bristles may spread out when the brush is applied to the nail, as illustrated in FIG. 4. Depending on a shape given to the housing 23, a wider or narrower bundle of bristles may be obtained.

At the second end 8, the stem 4 may include an endpiece configured to be fastened in the handle 9. The endpiece may comprise a tubular skirt 27, and a collar 29 that may be formed at a base thereof that is configured to come to bear against a top edge of the neck 28 when the applicator is in place on the receptacle 2. Below the collar 29, the stem 4 may include a cone-shaped portion 30 that may be capable of contributing to closing the receptacle 2 in a leaktight manner when the applicator 3 is in place on the receptacle.

Naturally, the stem 4 may be fastened onto the handle 9 in some other way, and, for example, may be made integrally, i.e., monolithically, with the handle, or fastened to the handle by adhesive, heat sealing, or force fitting, or by a fastener element fitted on the handle and/or on the stem.

For example, the stem 4 may be made of a thermoplastic material such as a polyolefin, for example, polyethylene or polypropylene, or may be made of other plastics materials such as POM, PA, PET, and/or PBT.

During use, at least one stamped portion 10 may make it possible for adjacent stem segments to pivot relative to each other, as illustrated in FIG. 4, thereby making it possible to obtain smoother application, for example. Where appropriate or desired, a shape of each stamped portion 10 may be selected in such a manner as to limit a pivot angle of adjacent segments. For example, the pivot angle may be determined by a length l of the stamped portion, measured between the adjacent segments, as illustrated in FIG. 3, and by a shape of the flanks facing the segments.

When the user ceases to press the applicator member 6 against the surface to be treated, each stamped portion 10 may spread out elastically to a greater or lesser extent depending on the material used to make the stem, so as to return the first end 5 and the applicator member 6 into alignment with the second end 8.

In another exemplary embodiment, the stem need not return to its initial shape after application.

In the exemplary embodiment in FIGS. 1 to 4, the stem 4 may include two stamped portions 10. It is contemplated that the stem 4 may include a different number of stamped portions, for example, a single portion, as illustrated in FIG. 7, or more portions, as illustrated in FIGS. 5 and 6.

In exemplary embodiments in which the stem 4 includes a large number of stamped portions, the stem 4 may be deformed almost continuously during application, with each stem segment adjacent to a stamped portion sloping by an angle that may be relatively small relative to the adjacent segment(s), for example.

A stamped portion 10 may include a longitudinal cross-section of substantially triangular shape over at least a fraction of a length thereof, as illustrated in FIG. 8, thereby making it possible, depending on the angle formed between the facing flanks of the adjacent stem segments, to define a maximum pivot angle. In another exemplary embodiment, the stamped portion 10 may include a longitudinal cross-section of substantially rectangular or trapezoidal shape, as illustrated in FIG. 9, thereby enabling pivoting to be greater.

A length a of a bridge of material 13 of a stamped portion 10, measured along the longitudinal axis of the stem, may lie in a range of about 0.1 mm to about 25 mm, for example.

A minimum thickness b of the bridge of material 13 of a stamped portion 10 may be 0.1 mm, for example.

A diameter of a circle in which the cross-section of the stem is inscribed prior to stamping may not be greater than about 10 mm, for example.

A stamped portion 10 may comprise a bridge of material 13 that connects two adjacent stem segments 14, 15, and that may be provided with at least one notch 18, as illustrated in FIG. 10, so as to make pivoting even easier. The notch 18 may advantageously be formed during stamping.

For example, the bridge of material 13 may lie on the longitudinal axis of the stem X, as illustrated in FIGS. 8 to 10, In another exemplary embodiment, the bridge of material 13 may be offset relative to the longitudinal axis X, as illustrated in FIG. 11.

Figure 13:
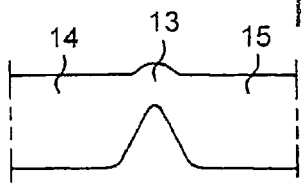

Still in another exemplary embodiment, the bridge of material 13 may include one side lying substantially in line with the segments 14 and 15 that the bridge of material 13 connects, as illustrated in FIG. 12, and may possibly include a small projection on a side remote from a recess resulting from the stamping, as illustrated in FIG. 13.

The bridge of material 13 may be solid, or, in another exemplary embodiment, may include an opening formed by being cut out during the stamping operation.

Figure 14:
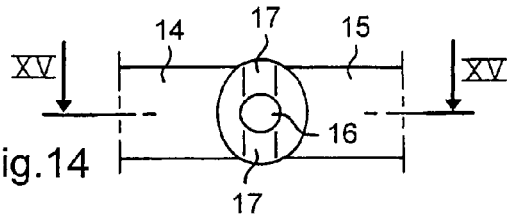
Figure 15:
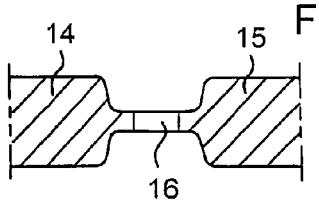
FIG. 15 is a longitudinal cross-section taken along XV-XV in FIG. 14.

For example, FIGS. 14 and 15 illustrate a stem including at least one stamped portion 10 including at least one opening 16, disposed between two branches 17 interconnecting the segments 14 and 15. The branches may optionally be rectilinear, or optionally concentric.

The stem 4 may include stamped portions that are all identical, for example, including a same profile when the stem is observed perpendicularly to the longitudinal axis X, or may include stamped portions including the same profile in a first direction that is perpendicular to the longitudinal axis X, and different profiles when observed in a second direction that is perpendicular to the longitudinal axis X, and that is also perpendicular to the first direction, for example. Still in another exemplary embodiment, the stem may include at least two stamped portions including a different profile whatever the direction in which the stem is observed.

Figure 16:
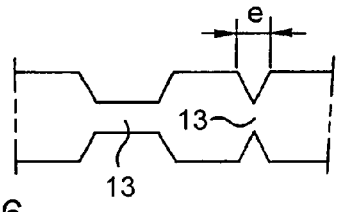

The stem may include at least two stamped portions 10 including different shapes, as illustrated in FIG. 16, with one stamped portion comprising a bridge of material 13 that may be longer than the other. For example, this may make it possible to further control the way in which the segments tend to pivot relative to each other during use.

In all of the embodiments described above, the stamped portions illustrated may be symmetrical about a mid-plane of the portion, and may be perpendicular to the longitudinal axis X of the stem. It is contemplated, however, that this may be otherwise.

Figure 17:
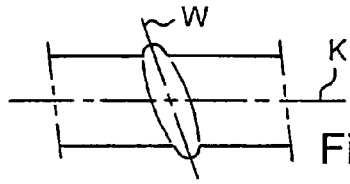
Figure 18:
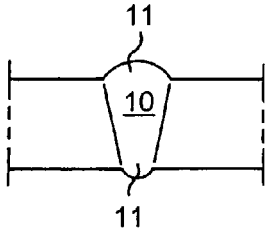
Figure 19:
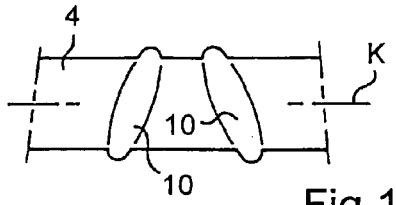

For example, FIGS. 17 to 19 illustrate exemplary embodiments of stamped portions that extend in a non-symmetrical manner about a plane that is perpendicular to the longitudinal axis X of the stem.

In the exemplary embodiment in FIG. 17, the stamped portion may define a hinge axis W that is not perpendicular to the longitudinal axis X of the adjacent stem segment.

In the exemplary embodiment in FIG. 18, the stamped portion may be substantially trapezoidal, comprising two asymmetric beads 11 disposed on either side of the stem.

In the exemplary embodiment in FIG. 19, the stem 4 may comprise two stamped portions 10 that extend obliquely while being symmetrical relative to each other about a plane that is perpendicular to the longitudinal axis X of the stem.

Figure 20:
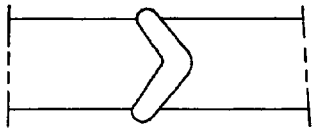
Figure 21:
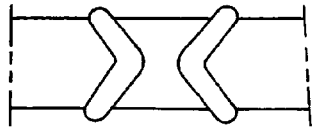

In the exemplary embodiments described above, the bottom wall of the stamped portions may extend along a rectilinear line, for example, that is perpendicular to the longitudinal axis of the stem. However, it is contemplated that this may be otherwise. For example, FIGS. 20 and 21 illustrate exemplary embodiments of bent stamped portions.

At least one stamped portion 10 may include at least one projection of material that is situated on at least one of the flanks of the adjacent stem segments.

Figure 22:
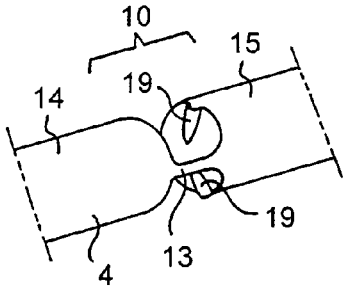
FIG. 22 is a diagrammatic and fragmentary perspective view of another exemplary embodiment of the stem.

For example, FIG. 22 illustrates an exemplary stem 4 including a stamped portion 10 interconnecting two segments 14 and 15 of the stem that include, on respective flanks 20 thereof, two projections of material 19 that are situated on either side of the bridge of material 13. Where appropriate or desired, the projections may serve to limit the degree to which one segment pivots relative to the other, and/or may act on a flow of composition along the stem during application.

The first end 5 of the stem 4 may include different cross-sections at the housing 23 configured to receive the applicator member 6.

FIGS. 23 to 31 illustrate various exemplary cross-sections, amongst others. For example, the cross-section may be circular as illustrated in FIG. 23, oblong as illustrated in FIG. 24, for example, oval or elliptical, polygonal as illustrated in FIGS. 25 and 26, for example, square or rectangular, kidney-shaped as illustrated in FIG. 27, star-shaped as illustrated in FIG. 28, or notched as illustrated in FIG. 29.

The stem 4 may include at least one longitudinal groove 30 opening level with a middle of a long side of the housing containing the bristles, for example, as illustrated in FIGS. 30 and 31. In the exemplary embodiment in FIG. 31, the cross-section of the stem may be coaxial about the cross-section of the housing, and the thickness of the stem may be substantially constant over an entire periphery of the housing.

The bristles of the applicator member 6 may be of a very wide variety of kinds. For example, bristles may be used that include one of the cross-sections illustrated in FIGS. 37 to 43, for example, a solid cross-section of circular outline as illustrated in FIG. 37, a hollow cross-section, for example, of circular outline, as illustrated in FIG. 38, a polygonal cross-section, for example, square as illustrated in FIG. 39, triangular as illustrated in FIG. 40, rectangular as illustrated in FIG. 41, or even an oblong cross-section, for example, of elliptical outline as illustrated in FIG. 42. The bristles may also include at least one capillary channel, as illustrated in FIG. 43.

The bundle of bristles may comprise a mixture of kinds of bristle, as indicated above.

The bundle of bristles 6 may be given any shape, for example, with the bundle being trimmed while the bristles are in place on the stem. Free ends of the bristles may be trimmed in such a manner that the end of the applicator is rectilinear as illustrated in FIG. 32, being perpendicular to the axis of the stem 4, or including a concave curved shape as illustrated in FIG. 33, a convex shape as illustrated in FIG. 34, a chamfered shape as illustrated in FIG. 35, or even trimmed to a pointed shape as illustrated in FIG. 36.

Naturally, the invention is not limited to an applicator member 6 constituted by a bundle of bristles. For example, the applicator member may comprise a flocked endpiece as illustrated in FIG. 45, or a flocked tip as illustrated in FIG. 44. For example, the flocked tip may be configured to apply composition to skin, lips, hair, or nails, for example, lips, eyelids, or nails.

The applicator member 6 may also comprise any other applicator member such as a foam, a brush, felt, a comb, or an applicator including capillarity, for example, as a function of the kind of composition and the surface to be treated. Further, the applicator member 6 may possibly be made integrally, i.e., monolithically, with the first end 5 of the stem 4, or fitted therein.

In exemplary embodiments in which at least one stamped portion 10 is made with a cross-section that is not circularly symmetrical, thus giving the stem 4 at least one preferred direction of deformation about a hinge axis W, the handle may be made with a shape that causes the user to hold the handle in a predetermined manner, in association with the orientation of the cross-section of the stamped portion 10.

For example, the handle may include, on two sides that are remote from each other, recesses 33 or flats that serve to receive the fingers of the user, as illustrated in FIG. 46.

The stamped portion(s) 10 and the handle may include generally flat shapes along a common plane that is substantially parallel to at least one of the hinge axes W, the stem 4 being able to deform perpendicularly to the plane.

In the exemplary embodiment in FIG. 1, the device may not include a wiper member, and the applicator member 6 may, for example, be wiped on the neck 28 of the receptacle 2 while the applicator 3 is being removed from the receptacle.

In another exemplary embodiment, and as illustrated in FIG. 47, the device may include a wiper member 34 disposed in the neck 28 of the receptacle. For example, the wiper member 34 may include an orifice, of diameter substantially equal to a diameter of the stem 4, through which the applicator member 6 may pass.

The exemplary applicators described above may be manufactured by a die 40 comprising two jaws 41 and 42 that are movable relative to each other, and that are configured to move toward each other so as to stamp the stem, as illustrated in FIG. 48.

FIG. 48 illustrates the stem received in the bottom jaw 42, which may be stationary and includes a recess 43. For example, the top jaw 41 may include a projection 44 including a profile that is to be hollowed out of the stem, as illustrated diagrammatically in FIG. 49.

In the exemplary embodiment in FIGS. 48 and 49, the zone of the bottom jaw 42 on which the movable jaw 41 comes to bear may be planar. In another exemplary embodiment, the jaw 42 may also include a projection 44, as illustrated in FIG. 50. Still in another exemplary embodiment, the jaws 41 and 42 may be configured to give the stem a non-rectilinear shape during stamping. For example, and as illustrated in FIG. 51, the jaws 41 and 42 may be of generally curved shape, with one being concave and the other being convex.

The stem may already be provided with the applicator member during the stamping operation. The applicator member may thus be put into place more easily on a stem that is straight and relatively rigid.

The invention is not limited to the exemplary embodiments described above. For example, characteristics of the various embodiments may be combined with one another.

The expression "comprising a" should be understood as being synonymous with "comprising at least one", unless specified to the contrary.

Although various details of the present invention herein have been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

What is claimed is:

1. A method of manufacturing an applicator for applying a cosmetic or a skin care product, comprising:

a) providing a stem having a housing; and b) stamping at least one portion of the stem to form at least one stamped, portion comprising a joint, the stamped portion defining a hinge axis, (i) providing an applicator member disposed at a first end of the stem, said applicator member comprising a bundle of bristles, the applicator member having a proximal end, the proximal end of the applicator member being present in said housing to fasten the applicator member to the stem, the housing including an oblong cross-section that is elongate along a long axis, so as to form a flat bundle of bristles, the joint not being in contact with the applicator member, and the long axis of the cross-section of the housing being substantially parallel to the hinge axis defined by the stamped portion, and (ii) providing a handle at a second end of the stem, said handle comprising a closure cap configured to close a receptacle containing the product to be applied.

2. A method according to claim 1, wherein the stem is stamped at ambient temperature.

3. A method according to claim 1, wherein the stem is hot stamped.

4. A method according to claim 1, wherein the stem comprises at least two stamped portions.

5. A method according to claim 1, wherein the stamped portion is not circularly symmetrical.

6. A method according to claim 1, wherein the stem is symmetrical about a mid-plane thereof.

7. A method according to claim 1, wherein at least one stamped portion is situated in the bottom half of the stem adjacent to the applicator member.

8. A method according to claim 1, wherein the stem comprises at least one bead resulting from stamping that forms a small lateral projection on the stem.

9. A method according to claim 1, wherein the stem comprises at least one stamped portion comprising at least one opening.

10. A method according to claim 9, wherein the at least one opening is disposed between two branches interconnecting stem segments that are situated on either side of the stamped portion.

11. A method according to claim 1, wherein the stamped portion comprises a bottom wall extending along a line that is not perpendicular to a longitudinal axis of the stem.

12. A method according to claim 1, wherein the stem comprises at least two stamped portions of different shapes.

13. A method according to claim 1, wherein the stem comprises at least two stamped portions comprising bottom walls that extend along lines that are not parallel.

14. A method according to claim 1, wherein the stem comprises at least two stamped portions of a same profile when the stem is observed in a direction that is perpendicular to its longitudinal axis thereof.

15. A method according to claim 1, wherein at least one stamped portion comprises at least one projection of material that is situated on at least one flank of a stem segment that is connected to the stamped portion.

16. A method according to claim 1, wherein at least one stamped portion presents a longitudinal cross-section of generally rectangular shape.

17. A method according to claim 1, wherein at least one stamped portion presents a longitudinal cross-section of generally triangular shape.

18. A method according to claim 1, wherein a shape of a cross-section of the stem is selected from the group consisting of: circular, oblong, oval, elliptical, polygonal, square, rectangular, kidney-shaped, notched, star-shaped and with one or more grooves.

19. A method according to claim 1, wherein the stem comprises a thermoplastic material.

20. A method according to claim 19, wherein the thermoplastic material is selected from the group consisting of: HDPE, LDPE, linear PE, PP, POM, PA, PET, and PBT.

21. A method according to claim 1, wherein the handle is fastened to the second end of the stem.

22. A method according to claim 1, wherein a shape of the handle is not circularly symmetrical.

23. A method according to claim 22, wherein the handle comprises at least one reception zone configured to receive a finger.

24. A method according to claim 23, wherein the handle comprises at least one of a flat and an indent that generally extends substantially parallel to a long axis of a cross-section of the stamped portion.

25. A method according to claim 1, wherein the stamped portion is configured to limit the degree to which stem segments that are situated on either side of the stamped portion pivot relative to each other.

26. A method according to claim 1, wherein the stamping is performed with a machine configured to receive the stem and comprising a die configured to stamp the stem so as to form the joint on said stem.

27. A method according to claim 1, wherein the product is a nail varnish or a nail care product.

28. A method according to claim 1, further comprising closing the receptacle containing the product with the closure cap.

29. A method according to claim 1, the stem being flexible enough to recover an original position after bending.

* * * * *